United States Patent [19]

White

[11] 4,076,601

[45] Feb. 28, 1978

[54] ELECTROLYTIC PROCESS FOR THE PREPARATION OF ETHANE-1,1,2,2-TETRACARBOXYLATE ESTERS AND RELATED CYCLIC TETRACARBOXYLATE ESTERS

[75] Inventor: Donald A. White, Creve Coeur, Mo.

[73] Assignee: Monsanto Company, St. Louis, Mo.

[21] Appl. No.: 744,006

[22] Filed: Nov. 22, 1976

[51] Int. Cl.[2] ..... C25B 3/10
[52] U.S. Cl. ..... 204/59 R
[58] Field of Search ..... 204/59 R, 72, 73 R, 204/73 A, 79

[56] References Cited

U.S. PATENT DOCUMENTS 3,871,976 3/1975 Connolly ..... 204/73 A

FOREIGN PATENT DOCUMENTS 124,011 11/1974 Japan ..... 204/59 R

*Primary Examiner*—F.C. Edmundson
*Attorney, Agent, or Firm*—Wendell W. Brooks; James W. Williams, Jr.; Joseph D. Kennedy

[57] ABSTRACT

Electrolytic dehydrodimeric coupling of malonate esters at elevated temperatures yields ethane-1,1,2,2-tetracarboxylate esters. Similar intramolecular coupling of bismalonate esters yields related cyclic tetracarboxylate esters in which the ethane-1,1,2,2-ethanetetracarboxylate moiety is incorporated into a ring.

17 Claims, No Drawings

ELECTROLYTIC PROCESS FOR THE PREPARATION OF ETHANE-1,1,2,2-TETRACARBOXYLATE ESTERS AND RELATED CYCLIC TETRACARBOXYLATE ESTERS

BACKGROUND OF THE INVENTION

This invention relates to an improved electrolytic process for the preparation of ethane-1,1,2,2-tetracarboxylate esters from malonate esters. The products are useful as precursors of the corresponding salts and free acids, and hydrates thereof, which are useful sequestrants and detergency builders.

Electrolytic dehydrodimeric coupling of diethyl malonate to yield tetraethyl ethane-1,1,2,2-tetracarboxylate has previously been reported in Okubo et al, *Technical Reports of Osaka University*, 13, 495 (1963) and Okubo et al, *Bulletin of the Chemical Society of Japan*, 37, 1794 (1964). In the former reference, the electrolysis was conducted on the sodium salt of diethyl malonate at 70° C but in the absence of iodide ion, while in the latter reference, the electrolysis was conducted on the free diethyl malonate at sub-ambient temperatures, for example, 10° C, in the presence of iodide ion electrolyte. The results, however, were less than satisfactory. For example, the current efficiency was 24 percent and 36 percent, respectively, with ethanol and acetonitrile as the solvent. In addition, the maximum percentage yield of product obtained was only 49 percent (in acetonitrile). Moreover, with ethanol as the solvent, the tetraethyl ethane-1,1,2,2-tetracarboxylate could not be isolated as a crystalline product, apparently due to the presence of numerous contaminating by-products.

It has now been discovered that the difficulties and disadvantages of the prior art methods are overcome by the process of the present invention wherein the electrolysis is conducted in the presence of iodide ion electrolyte and at elevated temperatures which represents a substantial improvement in the sense that:

(a) increased current efficiency in excess of about 65% is obtained;

(b) increased percentage yield of the desired ethane-1,1,2,2-tetracarboxylate ester products up to about 98 percent (based on the conversion of the malonate ester starting material) are obtained; and (c) increased product purity is achieved.

Various other advantages of this invention will become apparent from the accompanying description and claims.

SUMMARY OF THE INVENTION

According to the present invention, it has been discovered that malonate esters undergo electrolytic dehydrodimeric coupling at elevated temperatures to provide good yields of ethane-1,1,2,2-tetracarboxylate esters. The process comprises subjecting a liquid electrolysis medium containing the malonate ester, solvent, and iodide ion electrolyte to electrolysis at elevated temperatures sufficient to cause dehydrodimeric coupling of the malonate ester at a current efficiency in excess of about 65 percent.

The ethane-1,1,2,2-tetracarboxylate esters obtained in the present process can be readily recovered by any of a number of conventional and well-known procedures.

DETAILED DESCRIPTION OF THE INVENTION

Electrolytic dehydrodimeric coupling of malonate esters at elevated temperatures provides good yields of ethane-1,1,2,2-tetracarboxylate esters. In accordance therewith, an electric current is passed through a liquid electrolysis medium containing the malonate ester, solvent, and iodide ion electrolyte at elevated temperatures sufficient to cause dehydrodimeric coupling of the malonate ester at a current efficiency in excess of about 65 percent. Reactions (1), (2), and (3) show the reactions involved, the preparation of tetraethyl ethane-1,1,2,2-tetracarboxylate from diethyl malonate, in the presence of iodide ion electrolyte, being used for purposes of illustration.

(1) ANODE REACTION $2I^- \rightarrow I_2 + 2e^-$ (2) SOLUTION REACTION $I_2 + 2C^-H(COOC_2H_5) \rightarrow (C_2H_5OOC)_2CHCH(COOC_2H_5)_2 + 2I^-$ (3) CATHODE REACTION $2CH_2(COOC_2H_5)_2 + 2e^- \rightarrow 2C^-H(COOC_2H_5)_2 + H_2$ The net effect of reactions (1) through (3) of the present process is summarized in reaction (4).

(4) $2CH_2(COOC_2H_5)_2 \xrightarrow{electrolysis} (C_2H_5OOC)_2CHCH(COOC_2H_5)_2 + H_2$ While not desiring to be bound by the theory of the present invention, or to limit the invention in any way, it is believed that reactions (2) and (3) may actually involve additional steps. For example, reaction (2) may involve two additional steps as shown in reactions (5) and (6).

(5) $I_2 + C^-H(COOC_2H_5)_2 \rightarrow ICH(COOC_2H_5)_2 + I^-$ (6) $(C_2H_5OOC)_2C^-H + ICH(COOC_2H_5)_2 \rightarrow (C_2H_5OOC)_2CHCH(COOC_2H_5)_2 + I^-$ The additional steps believed to be involved in reaction (3) when the iodide ion is employed as the sodium salt and an alcohol, for example, ethanol is employed as the solvent are shown in reactions (7) through (10).

(7) $2Na^+ + 2e^- \rightarrow 2Na$ (8) $2Na + 2C_2H_5OH \rightarrow 2Na^+ + 2C_2H_5O^- + H_2$ (9) $2Na + 2CH_2(COOC_2H_5)_2 \rightarrow 2Na^+ + 2C^-H(COOC_2H_5)_2 + H_2$

(10) $2\,C_2H_5O^- + 2\,CH_2(COOC_2H_5)_2 \rightleftarrows 2C_2H_5OH + 2CH(COOC_2H_5)_2$ In a similar manner, when an aprotic solvent, for example, acetonitrile is employed as the solvent, reactions (7) and (9) are believed to be involved.

While it is believed that the SOLUTION REACTION and the CATHODE REACTION involve additional steps as illustrated, respectively, by reactions (5) and (6) and reactions (7) through (10), the overall effect, whatever the actual mechanistic pathway, is conveniently represented by reaction (2) and reaction (3), respectively.

From the above description and discussion it is apparent that iodine plays an important role in the course of the present process. Indeed, the surprising and unexpected improvement exhibited thereby is believed to be due to the fact that a key step in the present process, the reaction of molecular iodine with the malonate ester carbanion [reaction (2)], is rapid at the preferred elevated temperatures, but slow at the sub-ambient temperatures employed in the prior art. Support for this is evidenced by the accumulation in the electrolysis medium of brown color due to molecular iodine when the electrolysis is conducted at sub-ambient temperatures. Undesired cathodic reduction of molecular iodine to iodide ion then occurs, resulting in reduced current efficiency.

The malonate esters suitable for use in the present process must contain at least one hydrogen on the carbon atom located alpha or adjacent to the ester functional groups. These may be represented by the formula:

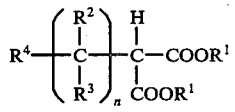

or, more simply, by the formula $R^4(CR^2R^3)_nCH(COOR^1)_2$ wherein $R^1$ represents a non-interfering hydrocarbyl group; $R^2$ and $R^3$ independently represent hydrogen or $R^1$; $R^4$ represents hydrogen, $R^1$, or a malonate ester moiety,

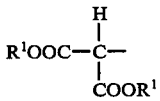

in which $R^1$ is as hereindefined; and $n$ represents any integer, with the proviso that $n$ may not be zero (0) when $R^4$ represents a malonate ester moiety.

It will be noted that since there are at least two $R^1$ non-interfering hydrocarbyl groups contained in the malonate esters as employed herein, $R^1$ can be the same or different; however, for practical reasons it is preferred that each $R^1$ contained in the malonate ester moieties be the same.

Representative of such malonate esters are dimethyl malonate, diethyl malonate, di-n-propyl malonate, di-i-propyl malonate, di-n-butyl malonate, di-t-butyl malonate, di-n-pentyl malonate, di-n-hexyl malonate, diphenyl malonate, and the like where $R^4$ represents hydrogen and $n$ represents the integer zero (0); dimethyl methylmalonate, dimethyl ethylmalonate, diethyl methylmalonate, diethyl ethylmalonate, dimethyl phenylmalonate, diethyl phenylmalonate, diphenyl phenylmalonate, and the like where $R^1$ and $R^4$ represent the same or different non-interfering hydrocarbyl group and $n$ represents the integer zero (0); tetramethyl propane-1,1,3,3-tetracarboxylate, tetraethyl propane-1,1,3,3-tetracarboxylate, tetramethyl butane-1,1,4,4-tetracarboxylate, tetra-t-butyl butane-1,1,4,4-tetracarboxylate, tetramethyl pentane-1,1,5,5-tetracarboxylate, tetraethyl pentane-1,1,5,5-tetracarboxylate, tetra-n-pentyl pentane-1,1,5,5-tetracarboxylate, tetramethyl hexane-1,1,6,6-tetracarboxylate, tetraethyl hexane-1,1,6,6-tetracarboxylate, tetraphenyl hexane-1,1,6,6-tetracarboxylate, tetraphenyl hexane-1,1,6,6-tetracarboxylate, and the like where $R^2$ and $R^3$ represent hydrogens, $R^4$ represents a malonate ester moiety, and $n$ represents any integer greater than zero (0).

It will of course be recognized that where the malonate ester moieties are both located in the same molecule (a bismalonate ester)—that is, where $R^4$ is a malonate ester moiety and $n$ is any integer greater than zero (0)—intramolecular coupling of the bismalonate can occur to produce cyclic tetracarboxylate esters in which the ethane-1,1,2,2-tetracarboxylate moiety is incorporated into a ring as illustrated in reaction (11).

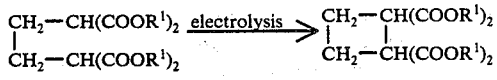

(11)

It will further be recognized that the usual chemical principles regarding the ease of ring formation versus the size of the ring being formed will apply. That is, the ease of ring formation increases with increasing ring size up to rings containing six carbon atoms and thereafter decreases to become increasingly difficult with increasing ring size. The difficulty of ring formation for rings containing three and four carbon atoms is usually attributed to ring strain, while the difficulty for rings containing from seven carbon atoms upward is attributed to the low probability of having reactive sites on the two fairly remote ends of a long hydrocarbon chain come together to effect cyclization. In such an instance coupling of reactive sites on the ends of different molecules usually occurs in preference to cyclization, unless the reaction is carried out in very dilute solution.

For these reasons, $n$ is the malonate ester formula preferably represents the integers 0, 1, 2, 3, and 4, with $n$ representing zero (0) being preferred for intermolecular dehydrodimeric coupling reactions and $n$ representing 1, 2, 3, and 4 being preferred for intramolecular coupling (cyclization) reactions.

Of these malonate esters, dimethyl malonate and diethyl malonate are preferred, where $R^1$ represents methyl and ethyl, $R^4$ represents hydrogen; and $n$ represents the integer zero (0), because they are more readily available and/or more readily prepared and (b) the dehydrodimeric coupled products obtained from other such malonate esters (where $R^1$ represents a non-interfering hydrocarbyl group of 3 or more carbon atoms) offer no advantage over those obtained from the preferred malonate esters.

For similar reasons tetramethyl propane-1,1,3,3-tetracarboxylate, tetraethyl propane-1,1,3,3-tetracarboxylate tetramethyl butane-1,1,4,4-tetracarboxylate, tetraethyl butane 1,1,4,4-tetracarboxylate, tetramethyl pentane-1,1,5,5-tetracarboxylate, tetraethyl pentane-1,1,5,5-tetracarboxylate, tetramethyl hexane-1,1,6,6-tetracarboxylate, and tetraethyl hexane-1,1,6,6-tetracarboxylate are preferred (where $R^1$ represents methyl and ethyl; $R^2$ and $R^3$ represent hydrogen; $R^4$ represents a malonate ester moiety containing the preferred $R^1$; and $n$ represents the integers 1, 2, 3, and 4).

As indicated hereinabove, the electrolysis of the present process is effected by passing an electric current through a liquid electrolysis medium comprising the malonate ester, solvent, and iodide ion electrolyte at elevated temperatures sufficient to cause substantial dehydrodimeric coupling of the malonate ester at a current efficiency in excess of about 65 percent. The medium must have sufficient conductivity to conduct the electrolysis current. While media of relatively poor conductivity can be employed, it is preferred from an economic viewpoint not to have too high a resistance. The required conductivity is generally achieved by employing iodide ion electrolytes, either alone or in conjunction with other compatible common electrolytes, along with a liquid having a fairly good dielectric constant. In general, any combination of iodide ion electrolyte and solvent can be employed which gives the desired conductivity and is sufficiently compatible with the malonate ester to permit its electrolytic dehydrodimeric coupling to the desired product at a current efficiency in excess of about 65 percent. It is generally desirable to have the iodide ion electrolyte, malonate ester, and solvent in a fairly homogeneous dispersion, but a true solution is not required as, for example, many quaternary ammonium salt solutions, may in some respects, be dispersions rather than true solutions. Thus the present invention may use emulsions as well as true solutions so long as sufficient amounts of the malonate ester and iodide ion electrolyte are dissolved or in solution so as to permit the desired dehydrodimeric coupling reaction to occur at a reasonable rate. Moreover, in emulsions or media having more than one phase, electrolysis can occur in a solution of the components in one of the phases.

The electrolytic dehydrodimeric coupling of the present process is preferably carried out in substantially anhydrous media. However, special precautions to assure the complete absence of water are not required in that the presence of small amounts of water cause no significant adverse effects on the course of the reaction. In general, commercially available anhydrous solvents are suitable and can be used without further treatment to remove residual water or moisture.

In the solvents employed in the present process, it will generally be desirable to select a solvent (a) which is relatively inert under the process conditions and (b) of fairly high dielectric constant in order to lower the electrical resistance. It will be understood, however, that the choice and concentration of electrolyte can also be used to lower electrical resistance.

The term "relatively inert" is employed herein to describe solvents which, under process conditions, (a) do not preferentially undergo substantial electrochemical reaction and (b) do not undergo significant adverse reaction with either the starting materials (malonate esters), intermediates generated therefrom, or the desired final products (ethane-1,1,2,2-tetracarboxylate esters and related cyclic tetracarboxylate esters).

Solvents desirable for use herein have dielectric constants of at least about 15, and preferably of at least about 25 or higher. Representative solvents include alcohols corresponding to the alcohol moiety of the ester groups (which avoids the difficulties associated with ester interchange such as, for example, methanol, ethanol, 1-propanol (n-propyl alcohol), 2-propanol (isopropyl alcohol or i-propyl alcohol), and the like, and common nitriles such as, for example, acetonitrile, propanenitrile, and the like. Among these solvents, methanol is preferred (when methyl esters are employed) in that (a) it has the highest dielectric constant of the simple alcohols; (b) it is the least expensive of the simple alcohols; (c) it gives higher current efficiencies than do the higher simple alcohols; and (d) the desired tetramethyl ester product has desirably low solubility in hot methanol.

Other preferred solvents are ethanol (when ethyl esters are employed) and acetonitrile. Acetonitrile is preferred primarily because its use leads to increased current efficiency, especially for esters containing alcohol moieties higher than ethanol.

In carrying out the present process, an electrolyte is used to enhance conductivity. An "electrolyte," as understood by those in the art, is a substance which dissociates into ions when in solution or a fused state and which, when in either state, will conduct an electric current. In most cases one of the more important criteria considered in selecting an electrolyte is that it should be incapable of discharging under the electrolysis conditions; however, in the present process, the iodide ion electrolyte is purposely selected to participate in the reaction. That is, the iodide ion electrolyte is one of the necessary reactants in the reaction of the present process, even though it is not actually consumed during the course of the reaction in that it is regenerated in situ for continued use as a reactant as the reaction proceeds.

Thus the iodide ion electrolyte must discharge at the anode to produce molecular iodine which in turn, it is believed, must react selectively with the malonate ester carbanion to produce an iodomalonate ester. The iodine must subsequently be displaced from the iodomalonate ester by another malonate ester carbanion to produce the desired ethane-1,1,-2,2-tetracarboxylate ester and regenerate the iodide ion for reuse as an electrolyte and as a reactant. This latter displacement step indicates that the iodine must easily be displaced as an iodide ion.

These reactions, describing the requirements for the iodide ion electrolyte to participate in the present process, are illustrated in general in reaction (2) and in greater detail in reactions (5) and (6).

The iodide ion electrolytes suitable for use in the present process are alkali metal iodides such as, for example, lithium iodide, sodium iodide, and potassium iodide, and quaternary ammonium iodides. Among the quaternary ammonium iodides useful herein are the tetraalkylammonium iodides such as, for example, tetramethylammonium iodide, tetraethylammonium iodide, tetra-n-propylammonium iodide, tetra-n-butylammonium iodide, and the like.

The term "quaternary ammonium" as employed herein has its usual recognized meaning of a cation having four organic groups substituted on the nitrogen.

Of the foregoing alkali metal iodides and tetraalkylammonium iodides suitable for use in the present process, sodium iodide and tetra-n-butylammonium iodide are preferred because of (a) their ready availability; (b) their high solubility; and (c) the ease of anodic oxidation of iodide ion to molecular iodine, which exhibits high selectivity for converting the malonate esters to the desired ethane-1,1,2,2-tetracarboxylate esters. Furthermore, sodium iodide and tetra-n-butylammonium iodide generally provide increased yield of desired product and, in addition, sodium iodide is relatively inexpensive. It will be recognized, however, that the actual yield of product will vary with electrode materials and their surface conditions, and various materials, including the malonate ester starting material and solvent, in the electrolysis medium.

The bromides, chlorides and fluorides of the alkali metals and the quaternary ammonium salts are generally not suitable to serve as the electrolyte due to the increased difficulty of being oxidized to the corresponding molecular halogen and the increased tendency of the corresponding molecular halogen of such halide ions to participate in adverse side reactions to produce undesired by-products, and thereby cause a substantial reduction in both current efficiency and product yield.

Thus the alkali metal and quaternary ammonium salts of the iodide ion are the electrolytes of choice in the present process.

As noted hereinabove, other compatible common electrolytes can be employed in conjunction with the halide ion electrolytes. That is, salts containing anions other than the iodide ions can be employed in addition to the iodide ion electrolyte salts, if desired, so long as they do not exert any adverse influence upon the course of the desired reaction, the product yield, or the current efficiency. Such salts, when employed in conjunction with the iodide ion electrolyte serve to increase the electric current-carrying capacity or conductivity of the electrolysis medium without increasing the iodide ion concentration. This may, in certain instances, be highly desirable, particularly where the iodide salt is difficultly soluble in the electrolysis medium.

The cations of choice for the electrolytes suitable for use in conjunction with the iodide ion electrolyte are those listed hereinabove—the alkali metal and quaternary ammonium cations. Suitable anions include for example, perchlorates, tetrafluoroborates and hexafluorophosphates.

The concentration of electrolyte salts can vary widely, for example, from about 0.5 percent to about 50 percent or more by weight of the electrolysis medium, but suitable concentrations will often be in the range of about 1.0 percent to about 15 percent by weight, or on a molar basis, often in the range of about 0.1 to about 1.0 molar. If, however, it is desired to have all the components in solution, the amount of the electrolyte salt utilized will be no greater than will dissolve in the electrolysis medium.

The concentration of the malonate ester starting material employed in the present process is not critical. All that is necessary is that sufficient amounts of the malonate ester is dissolved or in solution to permit the desired dehydrodimeric coupling reaction to proceed at a reasonable rate. Thus, for example, although concentrations as low as 0.1 percent by weight of the electrolysis medium can be employed, for reasons of efficiency and economy, it is preferred to employ concentrations of from about 5 percent to about 50 percent by weight, or even higher, of the malonate ester starting material in the electrolysis medium. In continuous operations, the malonate ester concentration will probably be maintained close to some constant value, and the ethane-1,1,2,2-tetracarboxylate ester product will also be present in fair amount in the electrolysis medium, depending upon the conversion obtained, as determined by the timing and amount of product separation. For example, the process can be operated at conversion rates of about 20 to 90 percent or so (or other desired rate), and the unreacted malonate ester recycled.

The process of the present invention is temperature dependent. Accordingly, the temperature should be maintained within the range of about 50° C to about 150° C. The temperature range can be even higher if a high-boiling solvent or a pressure cell is employed. The preferred temperature range, however, is between about 60° C and about 100° C, within which range are located the reflux temperatures of the preferred solvents.

The process of the present invention can be conducted at atmospheric pressure, superatmospheric pressures, and subatmospheric pressures. For reasons of economy, simplicity of operation, and ease of construction of the equipment employed in the process of the present invention, it is preferred to conduct the present process at approximately atmospheric pressure.

The present electrolysis is preferably conducted under an inert atmosphere or the like, for example, nitrogen in order to minimize possible deleterious effects of oxygen and other atmospheric conditions.

Various current densities can be employed in the present process. It will be desirable to employ high current densities in order to achieve high use of electrolysis cell capacity which will result in increased payload. Therefore, for production purposes it will generally be desirable to use as high a density as feasible, taking into consideration sources and cost of electrical current resistance of the electrolysis medium, heat dissipation, effect upon yields, and the like. Over broad ranges of current density, the density will not greatly affect the yield. And while low current densities are operable, more suitable ranges will generally be in the range of between about a few hundred amperes per square meter of anode surface up to 10,000 or 20,000 or more amperes per square meter.

The type of electrolysis cell in which the present electrolytic process is conducted is not critical. That is, the present electrolysis can be conducted in the various types of electrolysis cells known to the art. In general, such cells comprise a container made of material capable of resisting action of electrolytes, for example, glass or plastic, and one or more anodes and cathodes electrically connected to sources of electrical current. And, if desired, a porous or semipermeable divider can be employed to separate anode and cathode compartments such as a fritted glass filter, glass cloth, asbestos, poly(vinyl chloride), an ion exchange membrane, and the like, but a divider is not generally necessary, preferred, or even desirable.

The electrodes, that is, the anode and cathode, employed in the present process can be constructed of any electrode material so long as the material is relatively inert under the reaction conditions. Thus, for example, suitable anode materials include graphite, de Nora-type dimensionally stable anodes, the precious metals such as platinum, palladium, ruthenium, rhodium, and the like, and the precious metals plated onto other metals such as, for example, titanium and tantalum.

The de Nora-type dimensionally stable anodes employ precious metal oxides plated on a titanium substrate. Other materials include, for example, ruthenium oxide, mixed with oxides of titanium and tantalum, also plated on a titanium substrate. Dimensionally stable anodes suitable for use in the present process are currently commercially available from Diamond Shamrock Company, Cleveland, Ohio.

Among the anode materials included hereinabove, graphite and platinum are generally preferred, although it will be apparent to those skilled in the art that under conditions which cause substantial anode corrosion to occur, it will be advantageous to employ de Nora-type anodes which are sufficiently stable so as to eliminate any corrosion problems.

Suitable cathode materials include, for example, graphite and the precious metals such as platinum, palladium, ruthenium, rhodium, and the like. Among these, graphite and platinum are generally preferred.

The electrolysis cells employed in the procedural and illustrative EXAMPLES described hereinbelow are primarily for laboratory demonstration purpose. Production cells are usually designed with a view to the economics of the process, and characteristically have large electrode surfaces, and short distances between the electrodes.

For a general description of various laboratory scale electrolysis cells, see Lund et al, "Practical Problems in Electrolysis," in *Organic Electrochemistry* (Baizer, ed.), Marcel Dekker, New York, 1973, pp. 165–249, and for some considerations of industrial electrolysis cell designs, see Danly, "Industrial Electroorganic Chemistry," in Ibid., pp. 907–946.

The process of the present invention is suited to either batch or continuous operations.

Continuous operations can involve recirculation of a flowing electrolyte stream or streams between the electrodes, with continuous or intermittent sampling of the stream for product removal. Similarly, additional reactants can be added continuously or intermittently, and electrolyte salt or other electrolyte components can be augmented, replenished, or removed as appropriate.

The ethane-1,1,2,2-tetracarboxylate ester products obtained in the present process can be readily recovered by conventional procedures as the ester. It will be understood, however, that the isolation procedures employed in the procedural EXAMPLES and discussed hereinbelow are primarily for illustrative purposes. Other procedures can be employed, and may be preferred, for commercial use.

Upon completion of the electrolysis, the reaction mixture is cooled to ambient temperatures, or sub-ambient temperatures, to induce as complete crystallization as possible. The precipitated crystals are separated from the supernatant liquid, washed, preferably with the same solvent as that in which the electrolysis was conducted, and dried. Recrystallization, if desired, can be effected from a suitable solvent such as an alcohol corresponding to the alcohol moiety of the ester group, including methanol, ethanol, and the like, and inerttype hydrocarbon solvents such as pentane, hexane, high-boiling petroleum ether, cyclohexane, benzene, and mixtures thereof to yield the pure ethane-1,1,2,2-tetracarboxylate ester product.

Alternatively, the solvent can be evaporated in vacuo, and the resulting residue washed, dried, and recrystallized as described hereinabove to yield the pure ethane-1,1,2,2-tetracarboxylate ester product.

Varying amounts of numerous by-products are produced during the present process in addition to the desired ethane-1,1,2,2-tetracarboxylate (Compound I in REACTION SCHEME 1 hereinbelow, where $R^1$ is as described hereinabove) as indicated by gas liquid chromatographic analysis of the combined filtrates and washings or material isolated therefrom. For example, the by-products produced from the electrolytic dehydrodimeric coupling of dimethyl malonate (shown in REACTION SCHEME 1 hereinbelow, where $R^1$ is methyl, $CH_3$) include tetramethyl ethenetetracarboxylate (Compound II) and hexamethyl propane-1,1,2,2,3,3-hexacarboxylate (Compound III). In addition to the by-products produced, varying amounts of unreacted dimethyl malonate starting material are also present.

Similarly, the by-products produced from the electrolytic dehydrodimeric coupling of diethyl malonate (REACTION SCHEME 1 hereinbelow, where $R^1$ is ethyl, $C_2H_5$) include tetraethyl ethenetetracarboxylate (Compound II), hexaethyl propane-1,1,2,2,3,3-hexacarboxylate (Compound III), and triethyl ethane-1,1,2-tricarboxylate (Compound IV). Also present are varying amounts of unreacted diethyl malonate starting material.

On the other hand, where the malonate ester moieties are both located in the same molecule as described hereinabove so that intramolecular coupling of the bis-malonate can occur to produce cyclic tetracarboxylate esters in which the ethane-1,1,2,2-tetracarboxylate moiety is incorporated into a ring, the production of by-products is minimized, particularly where $n$ represents the preferred integers of 1,2,3, and 4. This is shown in REACTION SCHEME 2.

REACTION SCHEME 1

PRODUCTS AND BY-PRODUCTS $[R^4CR^2R^3{}_{n\ CH(COOR^1)_2}]$, where $R^1$ = a non-interfering hydrocarbyl group; $R^4$ = hydrogen; and $n$ = zero (0); which is equivalent to $CH_2(COOR^1)_2$]:

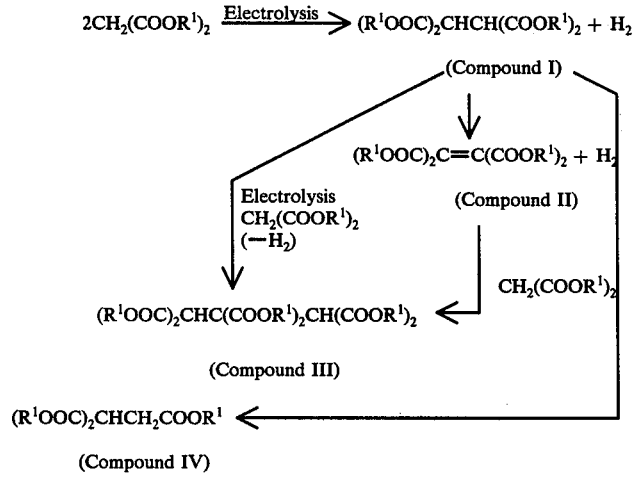

REACTION SCHEME 2

PRODUCTS $[R^4(CR^2R^3)_nCH(COOR^1)_2]$, where $R^1$ = a non-interfering hydrocarbyl group; $R^2$ and $R^3$ = hydrogen; $R^4$ = $(R^1OOC)_2CH$—, where $R^1$ is as hereindefined; $n$ = 1, 2, 3 and 4; which is equivalent to $(R^1OOC)_2CH(CH_2)_nCH(COOR^1)_2$]:

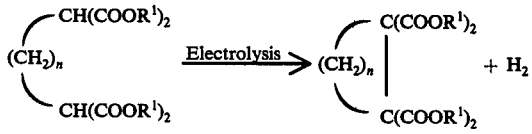

It will be apparent to those skilled in the art that since the desired dehydrodimeric products produced by the present process are esters, the corresponding free tetracarboxylic acids, which are useful as sequestrants and detergency builders can, if desired, be readily obtained therefrom by standard procedures.

The following examples illustrate the invention and the manner by which it can be practiced.

EXAMPLE 1

A 1-liter, 3-necked, round-bottomed flask equipped with a magnetic stirrer; two graphite-rod electrodes (12 inches × 0.25 inch diameter; 30.48 centimeters × 0.635 centimeter diameter) inserted, via two 10/18 standard taper joint Teflon thermometer adaptors, into a glass electrode adaptor having two 10/18 standard taper joints and one 34/45 standard taper joint; a water cooled reflux condenser, topped with a liquid paraffin bubbler and a nitrogen gas inlet, in one side neck; and a 10/18 standard taper joint thermometer placed in the remaining side neck via a 10/18–24/40 glass adaptor so as to extend into the electrolysis medium was used as an electrolysis cell. The graphite-rod electrodes were adjusted until they projected as far into the flask as possible, without interfering with the operation of the magnetic stirring bar.

A mixture of 264.0 grams (2.0 moles) of dimethyl malonate, 30.0 grams (0.2 mole) of sodium iodide, and 500 milliliters of absolute methanol was charged to the nitrogen-purged electrolysis cell, stirred until homogeneous, and heated to 60° C. The resulting solution was electrolyzed under a nitrogen atmosphere at a constant current of 3.0 amperes for 19 hours (which is equivalent to 57 ampere-hours which equal 2.13 Faradays which equal 1.06 Faradays per mole of dimethyl malonate). Throughout the electrolysis the solution, which was pale yellow in color, was maintained at a gentle reflux by the passage of current. As the electrolysis neared completion, white crystals separated from the solution. Upon completion of the electrolysis, the cell and its contents were allowed to cool to ambient temperatures. During the cooling period, additional crystals separated from the solution, and the supernatant liquid assumed a brown color. The crystals were collected by suction filtration and transferred, with methanol washing, to a blender where they were twice washed with methanol, with agitation, and collected by suction filtration. Air drying afforded 210.0 grams (0.802 mole) of white crystals, identified by nuclear magnetic resonance spectroscopy as tetramethyl ethane-1,1,2,2-tetracarboxylate (Compound I, where $R^1$ is methyl, $CH_3$).

The filtrate and methanol washing were combined and the solvent evaporated in vacuo to yield a residue which was taken up in chloroform. The chloroform solution was successively washed with water, saturated aqueous sodium bisulfite, and water, dried over anhydrous calcium sulfate, filtered, and evaporated in vacuo to yield 51.0 grams of solid-liquid-mixture. The mixture was converted to a homogeneous liquid by heating to 100° C. Examination of the liquid by nuclear magnetic resonance spectroscopy and gas liquid chromatography showed the presence of 26.0 grams (0.20 mole) of dimethyl malonate, 4.8 grams (0.018 mole) of tetramethyl ethane-1,1,2,2-tetracarboxylate (Compound I, where $R^1$ is methyl, $CH_3$), 6.6 grams (0.25 mole) of tetramethyl ethenetetracarboxylate (Compound II, where $R^1$ is methyl, $Ch_3$), and 13.6 grams (0.035 mole) of hexamethyl propane-1,1,2,2,3,3-hexacarboxylate (Compound III, where $R^1$ is methyl, $CH_3$).

TABLE 1

SUMMARY OF RESULTS OF EXAMPLE 1

| PRODUCT[a] ($R^1$=methyl, $CH_3$) | QUANTITY FORMED (moles) | MALONATE EQUIVALENT (moles) | YIELD (Percentage, %) | ELECTRICITY REQUIRED (Faradays, F) | CURRENT EFFICIENCY[b] (Percentage,%) |
|---|---|---|---|---|---|
| Compound I | 0.820 | 1.640 | 91.0 | 1.64 | 77.0 |
| Compound II | 0.025 | 0.050 | 2.8 | 0.10 | 4.7 |
| Compound III | 0.035 | 0.105 | 5.8 | 0.14 | 6.6 |
| TOTAL | | 1.795 | 99.6 | 1.88 | 88.3 |
| AMOUNTS CONSUMED | | 1.80 | | 2.13 | |

[a]Compound I = $(R^1OOC)_2CHCH(COOR^1)_2$; Compound II = $(R^1OOC)_2C{=}C(COOR^1)_2$; Compound III = $(R^1OOC)_2CH(COOR^1)_2CH(COOR^1)_2$.

[b]The less than 100 percent (88.3 percent) total current efficiency as accounted for by the detected products is apparently due to the utilization of the residual current (11.7 percent) to oxidize methanol as demonstrated in a blank experiment (that is, one containing no dimethyl malonate) wherein methanol was converted to methyl formate in 65 percent current efficiency and 80% yield.

EXAMPLE 2

The procedure and electrolysis cell described in EXAMPLE 1 above was employed with the exception that the electrolysis was conducted at 3.0 amperes for only 14.3 hours (which is equivalent to 42.9 ampere hours which equal 1.60 Faradays which equal 0.80 Faraday per mole of dimethyl malonate) to determine the effect of reduced conversion on percentage yield. The results, as summarized and tabulated in TABLE 2 hereinbelow, indicate that very high yields (up to about 98 percent) of tetramethyl ethane-1,1,2,2-tetracarboxylate (Compound I, where $R^1$ is methyl, $CH_3$) are obtained, with almost no contamination with undesired by-products such as, for example, tetramethyl ethenetetracarboxylate (Compound II, where $R^1$ is methyl, $CH_3$), and hexamethyl propane-1,1,2,2,3,3-hexacarboxylate (Compound III, $R^1$ is methyl, $CH_3$) at conversion rates no greater than about 70 percent. That is, when the dehydrodimeric coupling of the malonate ester to the ethanetetracarboxylate ester is conducted at a conversion rate no greater than 70 percent, yields of the ethanecarboxylate ester up to about 98 percent are obtained, with almost no contamination with undesired by-products.

EXAMPLE 3

The procedure and electrolysis cell described in EXAMPLE 1 above was employed, except that the electrolysis time was reduced to 10.75 hours (which is equivalent to 32.25 ampere-hours which equal 1.20 Faradays which equal 0.60 Faraday per mole of dimethyl malonate) to further define the effect of reduced conversion on percentage yield. The results, as summarized and tabulated in Table 2 hereinbelow, indicate that very high yields (up to 98 percent) of tetramethyl ethane-1,1,-2,2-tetracarboxylate (Compound I, where $R^1$ is methyl, $CH_3$) are obtained with almost no contamination with undesired by-products such as, for example, tetramethyl ethenetetracarboxylate (Compound II, where $R^1$ is methyl, $CH_3$), and hexamethyl propane-1,1,2,2,3,3-hexacarboxylate (Compound III, where $R^1$ is methyl, $CH_3$), at conversion rates no greater than about 50 percent.

EXAMPLE 4

An electrolysis cell essentially the same as that described in EXAMPLE 1 above was employed with the exception that a 500-milliliter flask was substituted for the 1-liter flask.

A solution of 160.0 grams (1.0 mole) of diethyl malonate, 30.0 grams (0.2 mole) of sodium iodide, and 200 milliliters of absolute ethanol was charged to the nitrogen-purged electrolysis cell and elecrolyzed under a nitrogen atmosphere at a constant current of 2.2 amperes for 12.33 hours (which is equivalent to 27.13 ampere-hours which equal 1.01 Faradays per mole of diethyl malonate). The passage of current heated the slution, which, due to unreacted iodine, maintained a brown color until the reflux temperature was reached, whereupon it became pale yellow. The pale yellow color was maintained until the electrolysis was essentially complete, at which time the solution again assumed a brown color. Upn completion of the electrolysis, the cell and its contents were cooled to 5 C to induce crystallization of the product. The crystals (106.0 grams) were collected by suction filtration and recrystallized from ethanol (110 milliliters) to yield 99.0 grams (0.31 mole) of tetraethyl ethane-1,1,2,2-tetracarboxylate (Compound I, where $R^1$ is ethyl, $C_2H_5$) as white crystals.

Gas liquid chromatographic analysis of the combined filtrates showed the presence of 48.0 grams (0.30 mole) of diethyl malonate, 11.0 grams (0.03 mole) of tetraethyl ethane-1,1,2,2-tetracarboxylate (Compound I, where $R^1$ is ethyl, $C_2H_5$), and undetermined trace amount tetraethyl ethenetetracarboxylate (Compound II, where $R^1$ is ethyl, $C_2H_5$), hexaethyl propane-1,1,2,2,3,3-hexacarboxylate (Compound II, where $R^1$ is ethyl, $C_2H_5$), and triethyl ethane-1,1,2-tricarboxylate (Compound IV, where $R^1$ is ethyl, $C_2H_5$).

The current efficiency for production of tetraethyl ethane-1,1,2,2-tetracarboxylate (Compound I, where $R^1$ is ethyl, $C_2H_5$) was 69 percent; the conversion of diethyl malonate was 70 percent; and the total percentage yield of tetraethyl ethane-1,1,2,2-tetracarboxylate (Compound I, where $R^1$ is ethyl, $C_2H_5$) was 98 percent (isolated, 88.6 percent) based on the conversion of diethyl malonate.

EXAMPLE 5

The procedure and electrolysis cell described in EXAMPLE 4 above was exployed except that platinum electrodes (0.98 inch × 1.18 inches × 0.005 inch thick; 25 millimeters × 30 millimeters × 0.13 millimeters thick) attached to platinum wires sealed in mercury filled 0.25-inch (6.35-millimeter) outside diameter Pyrex glass tubes were substituted for the graphite-rod electrodes.

The electrolysis was conducted at a constant current of 2.2 amperes for 11.66 hours (which is equivalent to 25.65 ampere-hours which equal 0.96 Faraday per mole of diethyl malonate) and the product isolated as described in EXAMPLE 4 above. The results, as summarized and tabulated in TABLE 2 hereinbelow indicate that when platinum electrodes are employed the current efficiency for the production of tetraethyl ethane-1,1,2,2-tetracarboxylate (Compound I, where $R^1$ is ethyl, $C_2H_5$), the conversion rate of diethyl malonate, and the total percentage yield of tetraethyl ethane-1,1,2,2-tetracarboxylate (Compound I, where $R^1$ is ethyl, $C_2H_5$) are essentially the same as those obtained when graphite rod electrodes are employed.

EXAMPLE 6

The procedure and electrolysis cell described in EXAMPLE 5 above was employed with the exception that acetonitrile was substituted for the absolute ethanol. As the electrolysis proceeded, progressive dicoloration of the solution occured until it was eventually dark brown. A considerable increase in resistance, which appeared to be due to electrode coating, also occurred as the electrolysis proceeded. The product was isolated as described in EXAMPLE 5 above and washed with ice-cold acetonitrile to give 62.0 grams of brownish crystals. Recrystallization from ethanol afforded 54.1 grams (0.17 mole) of tetraethyl ethane-1,1,2,2-tetracarboxylate (Compound I, where $R^1$ is ethyl, $C_2H_5$).

Gas liquid chromatographic analysis of the combined filtrates and washings showed the presence of 6.0 grams (0.04 mole) of diethyl malonate, 85.0 grams (0.27 mole) of tetraethyl ethane-1,1,2,2-tetracarboxylate (Compound I, where $R^1$ is ethyl, $C_2H_5$), and undetermined trace amounts of tetraethyl ethenetetracarboxylate (Compound II, where $R^1$ is ethyl, $C_2H_5$), hexaethyl propane-1,1,2,2,3,3-hexacarboxylate (Compound III, where $R^1$ is ethyl, $C_2H_5$), and triethyl ethane-1,1,2-tricarboxylate (Compound IV, where $R^1$ is ethyl, $C_2H_5$).

The current efficiency for the production of tetraethyl ethane-1,1,2,2-tetracarboxylate (Compound I, where $R^1$ is ethyl, $C_2H_5$) was 91 percent, the conversion of diethyl malonate was 96 percent, and the total percentage yield of tetraethyl ethane-1,1,2,2-tetracarboxylate (Compound I, where $R^1$ is ethyl, ($C_2H_5$) was 92 percent (isolated, 35.4 percent) based on the conversion of diethyl malonate.

The results are summarized and tabulated in TABLE 2 hereinbelow.

TABLE 2.

ELECTROLYTIC CONVERSION OF MALONATE ESTERS TO ETHANE-1,1,2,2-TETRACARBOXYLATE ESTERS

| EXAMPLE | $R^1$ | $R^4$ | n | SOLVENT | ELECTRODES | ELECTRICITY PASSED (Faradays/mole, of malonate ester) | CONVERSION (Percentage %) | YIELD (Percentage, %) | CURRENT EFFICIENCY for COMPOUND I[a] (Percentage, %) | CURRENT EFFICIENCY for COMPOUNDS I, II, & III (Percentage, %) |
|---|---|---|---|---|---|---|---|---|---|---|
| 1 | $CH_3$ | H | O | $CH_3OH$ | Graphite | 1.06 | 90 | 91 | 77 | 88 |
| 2 | $CH_3$ | H | O | $CH_3OH$ | Graphite | 0.80 | 69 | 98 | 85 | 87 |
| 3 | $CH_3$ | H | O | $CH_3OH$ | Graphite | 0.60 | 51 | 98 | 83 | 85 |
| 4 | $C_2H_5$ | H | O | $C_2H_5OH$ | Graphite | 1.02 | 70 | 98 | 69 | n.d. |
| 5 | $C_2H_5$ | H | O | $C_2H_5OH$ | Platinum | 0.96 | 69 | 99 | 71 | n.d. |
| 6 | $C_2H_5$ | H | O | $CH_3CN$ | Platinum | 0.97 | 96 | 92 | 91 | n.d. |

[a]Compond I = $(R^1OOC)_2CHCH(COOR^1)_2$; Compound II = $(R^1OOC)_2C{=}C(COOR^1)_2$; Compound III = $(R^1OOC)_2CHC(COOR^1)_2CH(COOR^1)_2$; n.d. = not determined.

EXAMPLE 7

An elongated 50-milliliter, 3-necked flask equipped with a magnetic stirrer; two graphite-rod electrodes (12 inches × 0.25 inch diameter; 30.48 centimeters × 0.635 centimeter diameter) inserted, via two 10/18 standard taper joint Teflon thermometer adaptor, into aglass electrode adaptor having two 10/18 standard taper joints and one 34/45 standard taper joint; a 14/20 standard taper joint water-cooled reflux condenser, topped with a liquid paraffin bubbler and a nitrogen gas inlet, in one side-neck; and a 10/18 standard taper joint thermometer placed in the remaining side-neck, so as to extend into the electrolysis medium was used as an electrolysis cell. The graphite-rod electrodes were adjusted until they projected as far into the flask as possible, without interfering with the operation of the magnetic stirring bar.

The electrolysis cell was flushed with nitrogen and charged with 2.9 grams (0.01 mole) of tetramethyl butane-1,1,-4,4-tetracarboxylate, 0.6 gram (0.004 mole) of sodium iodide, and 40 milliliters of absolute methanol. The solution was electrolyzed under a nitrogen atmosphere with a constant current of 1.0 ampere, the passage of which heated the solution to reflux. At reflux temperature the solution became pale yellow, which color was maintained throughout the remainder of the electrolysis. Periodic examination of withdrawn samples by gas liquid chromatography showed consumption of the tetramethyl butane-1,1,4,4-tetracarboxylate starting material and formation of a single product. The electrolysis was continued for 0.83 hour (which is equivalent to 0.83 ampere-hour which equals 0.031 Faraday which equals 3.1 per mole of tetramethyl butane-1,1,4,4-tetracarboxylate), at which time all the starting material had been consumed. The cell and its contents were cooled to ambient temperatures and the solvent evaporated in vacuo to dryness. The pale yellow residue was washed well with water and dried in vacuo to yield 2.74 grams of material which was identified as tetramethyl cyclobutane-1,1,2,2-tetracarboxylate by its nuclear magnetic resonance spectrum in deuterated chloroform. The spectrum showed singlet resonance peaks at 2.60 and 3.76 parts per million downfield from an internal tetramethylsilane reference with relative areas of 1:3. Recrystallization of a sample from a cyclohexane-benzene (70-30) mixture yielded crystalline tetramethyl cyclobutane-1,1,2,2-tetracarboxylate, melting point 80.5°-81° C.

The ethane-1,1,2,2-tetracarboxylate esters are useful as precursors of the corresponding salts and free acids, and hydrates thereof, which are useful sequestrants and detergency builders.

While the invention has been described with respect to various specific examples and embodiments thereof, it will be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. An electrolytic process for the preparation of tetramethyl ethane-1,1,2,2-tetracarboxylate from dimethyl malonate, which process comprises subjecting a liquid electrolysis medium containing the dimethyl malonate, substantially anhydrous methanol, and iodide ion electrolyte to electrolysis at elevated temperatures sufficient to cause dehydrodimeric coupling of the dimethyl malonate at a current efficiency in excess of about 65 percent, using a graphite anode and a graphite cathode, and thereafter recovering the tetramethyl ethane-1,1,2,2-tetracarboxylate.

2. The process of claim 1 wherein the concentration of the iodide ion electrolyte is between about 1.0 percent and about 15 percent by weight.

3. The process of claim 2 wherein the iodide ion electrolyte is an alkali metal iodide.

4. The process of claim 3 wherein the alkali metal iodide is sodium iodide.

5. The process of claim 2 wherein the iodide ion electrolyte is a quaternary ammonium iodide

6. The process of claim 1 wherein the quaternary ammonium iodide is tetra-n-butylammonium iodide.

7. The process of claim 1 wherein the iodide ion electrolyte is employed in conjunction with another electrolyte.

8. The process of claim 7 wherein the other electrolyte is an alkali metal salt.

9. The process of claim 8 wherein the alkali metal salt is sodium perchlorate.

10. The process of claim 7 wherein the other electrolyte is a quaternary ammonium salt.

11. The process of claim 10 wherein the quaternary ammonium salt is tetra-n-butylammonium perchlorate.

12. The process of claim 1 wherein the concentration of the dimethyl malonate in the electrolysis medium is between about 5 percent and about 50 percent by weight.

13. The process of claim 1 wherein the elevated temperature is between about 60° C and about 100° C.

14. The process ofclaim 1 wherein the dehydrodimeric coupling of the malonate ester to the ethanetetracarboxylate ester is conducted at a conversion rate no greater than about 70 percent.

15. The process of claim 1 wherein the electrolytic process is conducted under an inert atmosphere.

16. The process of claim 15 wherein the inert atmosphere is nitrogen.

17. A continuous process for the preparation of tetramethyl ethane-1,1,2,2-tetracarboxylate from dimethyl malonate which process comprises:

(a) charging to an electrolysis cell containing a graphite anode and a graphite cathode an electrolysis medium containing the dimethyl malonate, substantially anhydrous methanol, and iodide ion electrolyte;

(b) heating the electrolysis medium to a temperature between about 50° C and about 150° C;

(c) passing an electric current through the hot electrolysis medium to cause dehydrodimeric coupling of the dimethyl malonate to yield the tetramethyl ethane-1,1,2,2-tetracarboxylate;

(d) separating the tetramethyl ethane-1,1,2,2-tetracarboxylate from the electrolysis medium in which it exhibits low soluvility;

(e) recycling the electrolysis medium with added dimethyl malonate to the electrolysis cell to continue the reaction; and (f) repeating steps (b) through (f).

* * * * *